US009574252B2

(12) United States Patent
Wang et al.

(10) Patent No.: US 9,574,252 B2
(45) Date of Patent: Feb. 21, 2017

(54) METHODS OF REDUCING OLD OXIDES IN ALUMINUM CASTINGS

(71) Applicant: GM Global Technology Operations LLC, Detroit, MI (US)

(72) Inventors: Qigui Wang, Rochester Hills, MI (US); Dale A. Gerard, Bloomfield Hills, MI (US)

(73) Assignee: GM Global Technology Operations, LLC, Detroit, MI (US)

( * ) Notice: Subject to any disclaimer, the term of this patent is extended or adjusted under 35 U.S.C. 154(b) by 306 days.

(21) Appl. No.: 14/174,240

(22) Filed: Feb. 6, 2014

(65) Prior Publication Data

US 2014/0260805 A1 Sep. 18, 2014

Related U.S. Application Data

(60) Provisional application No. 61/789,016, filed on Mar. 15, 2013.

(51) Int. Cl.
*C22B 21/06* (2006.01)
*C22B 21/02* (2006.01)

(52) U.S. Cl.
CPC ..... *C22B 21/02* (2013.01); *C22B 21/062* (2013.01)

(58) Field of Classification Search
None
See application file for complete search history.

(56) References Cited

U.S. PATENT DOCUMENTS 3,649,247 A 3/1972 Brondyke et al.
3,982,889 A * 9/1976 Olson ..... F27B 9/00 432/128
4,319,921 A * 3/1982 Pryor ..... C22B 1/005 266/156
4,365,993 A 12/1982 Meredith et al.
4,439,145 A * 3/1984 Strassman ..... C22B 9/16 266/160
4,548,651 A * 10/1985 Ramsey ..... C22B 1/005 134/18
4,752,314 A * 6/1988 Fassbender ..... C03B 3/02 65/134.3

(Continued)

FOREIGN PATENT DOCUMENTS

JP 5651541 A 5/1981
JP S 5651541 A 5/1981

OTHER PUBLICATIONS

Wang, et al., Oxide Films, Pores and the Fatigue Lives of Cat Aluminum Alloys, Metall. Mater. Trans. 2006, pp. 887-895, vol. 37B, USA.

(Continued)

*Primary Examiner* — George Wyszomierski

(57) ABSTRACT

A method of reducing entrained aluminum oxides in aluminum castings. The method comprises preheating a furnace charge to remove moisture and contaminants. The furnace charge is then coated on all free surfaces with a layer of flux. Subsequently the furnace charge is melted in a furnace to form a melt bath of liquid aluminum suitable for casting. The flux layer removes the naturally occurring oxide film from the furnace charge surface as well as provides a cover flux to protect the melt bath from oxidation.

16 Claims, 2 Drawing Sheets

(56) References Cited

U.S. PATENT DOCUMENTS

| | | | | |
|---|---|---|---|---|
| 6,549,558 | B1 * | 4/2003 | Okada | C22B 9/16 373/77 |
| 2011/0074072 | A1 * | 3/2011 | Rauch | C22B 21/0084 266/166 |

OTHER PUBLICATIONS

Campbell, Castings—The New Metallurgy of Cast Metals, Elsevier Butterworth-Heinemann, 2003, pp. i, ii, iii, 17-31, Second Edition, Chapter 2, United Kingdom.

Yuanxiang, Skimming-Off and Melting Technology of Recycled Pop-Top Aluminum Alloy, China Nonferrous Metallurgy, No. 1, 2001.

D3 "Skimming-off and Melting Technology of Recycled Pop-top Alunmum Alloy", Z, Zhou Yuanxiang, China Nonferrous Metallurgy, No. 1, 2001.

* cited by examiner

METHODS OF REDUCING OLD OXIDES IN ALUMINUM CASTINGS

CROSS-REFERENCE TO RELATED APPLICATION

This application claims the benefit of U.S. Provisional Application No. 61/789,016 with a filing date of Mar. 15, 2013.

FIELD OF THE INVENTION

The present invention relates to methods of reducing oxides in liquid metal and, more particularly, to methodologies and techniques to reduce old aluminum oxides in aluminum castings.

BACKGROUND OF THE INVENTION

Oxide films form on aluminum alloys when they are exposed to an atmosphere containing oxygen. Specifically, aluminum readily oxidizes in the presence of air (Eqn. (1)), or moisture (Eqns. (2 and 3)), rapidly forming a thin, strong protective oxide film on any exposed aluminum metal surface, including both liquid and solid surfaces. Aluminum, particularly at elevated temperature has very high inherent potential for oxidation ($Al_2O_3$) when its surfaces are exposed to oxygen-containing environment.

$$4Al+3O_2 \rightarrow 2Al_2O_3 \quad (1)$$

$$3H_2O+2Al \rightarrow Al_2O_3+3H_2 \quad (2)$$

$$H_2 \rightarrow 2[H]_{melt} \quad (3)$$

Because aluminum oxide is very stable thermodynamically, it is typically present in all aluminum alloys. Therefore, any furnace charge contains unavoidable amounts of alumina as a typical coating. During the mold filling of the casting process, additional aluminum oxides are formed when the free surface of the melt front contacts air and particularly when the liquid melt velocity produces turbulent flow. A distinction is often made between oxides pre-existing in the melting furnace, referred to as "old oxides," and those created during mold filling, called "young oxides." Campbell, J., *Castings*, Elsevier Butterworth-Heinemann, 2003; Q. G. Wang, C. J. Davidson, J. R. Griffiths, and P. N. Crepeau, "Oxide Films, Pores and The Fatigue Lives of Cast Aluminum Alloys", Metall. Mater. Trans. vol. 37B (2006), pp. 887-895.

The "old" oxides formed before and during melting can be suspended in the melt and be transferred to the casting. The oxides cause a variety of downstream problems unless special precautions are taken. For example, entrained oxides are believed to increase melt viscosity and apparent surface tension, hence reducing fluidity and adversely affecting feeding of castings.

The presence of oxides in aluminum alloys has also been well recognized to be detrimental to the mechanical properties, in particular fatigue performance, of aluminum castings. Oxide films have been reported as the second most common origin for fatigue crack initiation in aluminum castings. In addition to a reduction in mechanical properties, oxidation results in the consumption of valuable aluminum.

In melting and re-melting of aluminum alloys, a significant amount of aluminum dross can be produced on the top of the molten aluminum metal in the furnace. During the melting process, an average of 4-5% of the input material to the furnace is lost to oxidation. When the aluminum dross is skimmed off the liquid melt surface, up to 90% of the material removed is free aluminum metal. Dross, therefore, in an aluminum melting operation, includes a significant amount of aluminum metal.

The dross skimmed off from the liquid melt surface in the furnace is usually slowly cooled down on a foundry floor surface. Free aluminum metal in the dross is further lost due to a thermite reaction, i.e., exothermic oxidation of aluminum metal with a huge fresh melt surface. Typically, about 2% of the aluminum metal in the dross is lost for each minute of cooling. Therefore, a dross initially having about 80% aluminum metal will decrease to about 40% to 60% aluminum metal after cooling because of losses due to the thermite reaction.

To minimize and eventually eliminate the oxides in the final cast aluminum products, it is desired to reduce old oxides in the liquid metal to be fed to a mold for casting.

Although there is a strong practical need to remove old oxides from the liquid metal melt, no reliable method or technique has yet been reported.

BRIEF SUMMARY OF THE INVENTION

In accordance with one embodiment of the present invention, a method of reducing entrained aluminum oxides in aluminum castings is disclosed. The method comprises preheating a furnace charge to eliminate moisture and contaminants. The method further comprises coating the furnace charge free surfaces with a layer of flux before melting the furnace charge. Subsequently the furnace charge is melted in a furnace to form a melt bath with a melt surface.

In accordance with another embodiment of the present invention, a method of reducing entrained aluminum oxides in aluminum castings is disclosed. The method comprises preheating a furnace charge to at least approximately 150° C. to remove moisture and other contaminants. The furnace charge is also coated with a layer of flux on all free surfaces to a thickness of at least approximately 1 mm in thickness. The flux comprises NaCl and KCl in an equimolar ratio and chlorides of Li, Ca, or Mg; sulfates of Mg, Na, or K; or their combination. Subsequently the furnace charge is melted in a furnace to form a melt bath with a melt surface. Injecting additional flux into the melt bath beyond that introduced from the flux coating layer is not done in accordance with method.

In accordance with another embodiment of the present invention, a method of reducing entrained aluminum oxides in aluminum castings is disclosed. The method comprises preheating a furnace charge to between approximately 150° C. and approximately 500° C. The preheating is achieved in a rotary kiln with an oxygen level maintained between 1% and 2% oxygen by volume. The method further comprises coating the furnace charge free surfaces with a layer of flux to a thickness of approximately 1 mm to approximately 2 mm. The flux comprises approximately 30.8% by weight NaCl, approximately 39.2% by weight KCl, approximately 5.0% by weight $CaCl_2$, approximately 5.0% by weight LiCl, approximately 5.0% by weight $MgCl_2$, approximately 5.0% by weight $Na_2SO_4$, approximately 7.5% by weight $K_2SO_4$ and approximately 2.5% by weight $MgSO_4$. Subsequently the furnace charge is melted in a furnace to form a melt bath with a melt surface. Injecting additional flux into the melt bath beyond that introduced from the flux coating layer is not done in accordance with method.

Accordingly, it is an object of the present invention to reduce aluminum oxides in the liquid aluminum used for casting and thus to reduce the potential of aluminum oxides entrained in the castings. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1A:
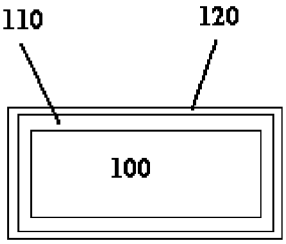
FIG. 1A is a schematic illustration of the aluminum oxide detachment process before melting of the aluminum.
Figure 1B:
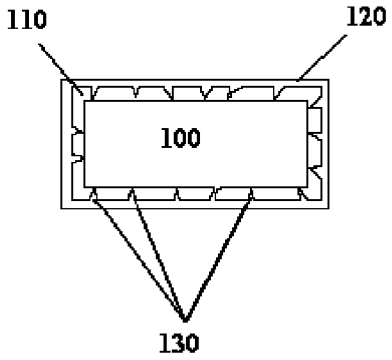
FIG. 1B is a schematic illustration of the aluminum oxide detachment process during melting of the aluminum.
Figure 1C:
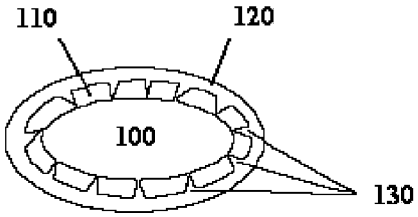
FIG. 1C is a schematic illustration of the aluminum oxide detachment process after melting of the aluminum.

Referring initially to FIG. 1, an embodiment of a method of reducing entrained aluminum oxides in aluminum castings is illustrated. Because it is thermodynamically very stable, aluminum oxide 110 is typically present in all aluminum alloys. Any furnace charge 100, such as ingots and casting scraps, will, therefore, contain unavoidable amounts of an aluminum oxide 110 as a typical coating, thus constituting an exogenous inclusion source. To remove the surface aluminum oxide 110 from the furnace charge 100 and particularly make them float to the melt surface easily, the solid furnace charge surface is coated with a flux layer 120 by simply dipping the furnace charge into a molten flux bath.

A method of reducing entrained aluminum oxides in aluminum castings comprises preheating a furnace charge 100, coating the furnace charge with a flux layer 120, and melting the furnace charge in a furnace to form a melt bath with a melt surface. Old aluminum oxides 110 are those formed before and during melting. Many old aluminum oxides 110 in liquid metal are from the dirty furnace charge 100 such as recycled gating, risers and casting scraps. To reduce the aluminum oxides 110 from the furnace charge 100 entering the final cast product, the furnace charge free surfaces are coated with a flux layer 120. The coated flux layer 120 can not only help strip the aluminum oxide 110 from the furnace charge 100 surfaces after being added into the liquid aluminum but also assist the stripped oxides in floating to the melt bath surface. The remaining effective fluxes floated to the melt surface serve as cover flux to further protect liquid melt from continuous oxidation during melting.

In an embodiment, prior to dipping the furnace charge 100 into the flux bath, the furnace charge 100 is preheated. The heating dries out the moisture and removes other volatiles from the charge. Removal of the moisture and volatile components mitigates the risk of an explosion in the furnace and inhibits slag formation from absorption of hydrogen formed when hot aluminum comes in contact with moisture.

When the furnace charge 100 comprises aluminum scraps from containers, sidings, and other coated products preparation of the furnace charge preferably involves removal of paint, lacquers, machining oils, and other contaminants. In an embodiment this removal is accomplished thermally. Specifically, preheating and contaminant removal may be accomplished by natural gas heating in an embodiment. Preferably, the hot flue gases of the melting furnace are utilized to pretreat and preheat the furnace charge 100. However, it is envisioned in an embodiment that alternative heating sources, including new fuel, are utilized to pretreat and preheat the furnace charge. 100.

Removal of moisture, volatile components, paint, lacquers, machining oils, and other contaminants from furnace charges 100 is achieved by heating the furnace charges. In an embodiment the furnace charge 100 is preheated to at least approximately 150° C. More specifically, in an embodiment the furnace charge 100 is preheated to between approximately 150° C. and approximately 500° C.

In an embodiment the furnace charge 100 is decoated in a low-oxygen, controlled atmosphere rotary kiln. Hot gases enter the kiln's center tube, flow parallel to the furnace charge 100, and vaporize the organics in the furnace charge in the kiln. The oxygen in the kiln is kept below the flammability limits of the organic components, avoiding combustion in the kiln. In an embodiment the oxygen level in the rotary kiln is preferably maintained below 6% oxygen by volume. In an embodiment the oxygen level is maintained between 1% and 2% oxygen by volume.

In an embodiment of the method reducing entrained aluminum oxides in aluminum castings the furnace charge 100 is coated with the flux layer 120 by dipping the furnace charge into a molten flux bath. The dipping action forms a flux layer 120 covering all surfaces of the furnace charge 100.

In an embodiment the flux layer 120 is at least approximately 1 mm thick on the surfaces of furnace charge 100. The thickness of the flux layer 120 on the furnace charge 100 depends upon the temperature of the furnace charge when it is dipped into the flux bath and the time the furnace charge is immersed in the liquid flux. In another embodiment the flux layer 120 is approximately 1 mm to approximately 2 mm thick on the surfaces of furnace charge 100.

Energy can be lost during the loading process of furnace charge 100 into the furnace for melting. If batch furnaces are loaded cold, the melting operation becomes inefficient as the entire furnace mass must be heated along with the metal. However, in an embodiment it is envisioned utilizing a batch furnace to melt the furnace charge 100. Conversely, opposed to a batch furnace, a continuously operated furnace offers efficiency, not requiring additional energy to heat up the furnace in each melting cycle. However, loading a hot furnace requires opening the furnace door or lid, which allows vast quantities of heat to escape by convective flow of hot gases and by radiation. In an embodiment techniques and systems to minimize heat loss during furnace charge 100 loading are envisioned. For example, in an embodiment a side well furnace is used to heat and melt the furnace charge 100. In a side well furnace heat loss is minimized as molten metal circulates through the charge well and back into the hearth for reheating during the charging period of the furnace cycle. In an embodiment, the furnace charge 100 is submerged into the molten bath for melting which reduced metal lost to oxidation.

In an embodiment, upon melting the furnace charge 100 with a flux layer 120, the excess flux is allowed to float to the melt surface and form a cover flux for the melt bath. Exposure to air results in aluminum forming aluminum oxide and thus without a cover flux the hot surface of the melt bath would react with air and form aluminum oxide.

In an embodiment additional flux beyond that introduced from the flux coating layer 120 is not introduced into the melt bath. Traditionally fluxes are injected into the melt bath at regular intervals to clean liquid metal of oxides. The liquid metal is cleaned of oxides as a result of the flux introduced as the flux layer 120. Excess useable flux from the flux layer 120 is floated to the melt surface collecting oxides in the process. Additionally, the excess usable flux, along with the removed oxide films from the furnace charge, serve as cover flux to further protect the melt bath from continuous oxidation.

The flux layer 120 aids in removal of oxides from the furnace charge 100 and the liquid metal. Surface and interfacial phenomena between aluminum oxides 110, free aluminum metal and salt compounds (flux) play an important role in the removal of oxides from the aluminum during melting. The important role of surface and interfacial phenomena between aluminum oxide 110, free aluminum and salt compounds is because interfacial properties strongly affect the rates of any reactions that occur across the involved phases. To eliminate aluminum oxides 110 in the liquid metal, the oxide films that stick to the aluminum must first be broken and at least partially removed so that the flux can contact the interface between the aluminum oxide films and the aluminum.

The mechanism of oxide film removal can be explained by the interfacial tension forces between the molten aluminum and the aluminum oxide film 110. For removal of the aluminum oxide film 110 to occur, the sum of the interfacial tensions of molten aluminum/molten salt and aluminum oxide film/molten salt should be less than the interfacial tension between the molten aluminum and the oxide films. This relationship is represented in equation (4).

$$\gamma_{Al/salt}+\gamma_{oxide/salt}<\gamma_{Al/oxide} \quad (4)$$

Thermodynamically, this criterion is never satisfied. Based on the interfacial turbulence phenomena, however, it is believed that at the initial stage of aluminum oxide detachment the salt first penetrates to the fresh aluminum surface through small cracks 130 in the aluminum oxide film 110. These small cracks 130 develop during heating of the furnace charge 100 because the underlying aluminum expands more than the aluminum oxide films 110. The melted liquid aluminum tends to become a spherical shape and the salts in the flux layer 120 starts to react with fresh aluminum chemically through the small cracks 130 in the aluminum oxide film 110.

When the molten salt in the flux layer 120 reacts with fresh aluminum, surface-active elements such as sodium and potassium may be absorbed onto the aluminum surface, leading to the decrease of interfacial tension between the aluminum and the salt. Since the adsorption of salt ions such as sodium and potassium is not uniform along the entire surface of the aluminum droplets, due to non-uniform distribution of small crevices (cracks) 130, a concentration gradient exists along the surface. This concentration gradient results in the aluminum liquid tending to spin because of interfacial movement. This movement creates a stripping force that separates the aluminum oxide layer 110 from the liquid aluminum. For instance, in an equimolar NaCl—KCl salt system, the interfacial tension between aluminum and salt is 710 mN/m but when NaF is added to this system, the value decreases to 450 mN/m. The liquid aluminum will spin towards the area where the interfacial tension between aluminum and salt is higher (710 mN/m in this case) resulting in lower overall energy of the entire system.

Figure 2:
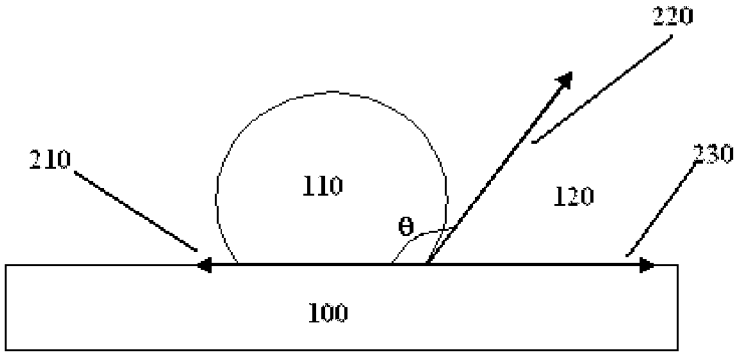
FIG. 2 is a schematic illustration of the interfacial tension forces acting on the aluminum liquid droplet and aluminum oxide substrate.

Referring to FIG. 2, there is an aluminum liquid droplet on a flat oxide film in molten salt. Three interfacial tension forces act on the wetted aluminum droplet. There is an interfacial force between the aluminum droplet and the aluminum oxide film 210 ($\gamma_{Al/oxide}$). There is another interfacial force between the aluminum and the salt 220 ($\gamma_{Al/salt}$). Finally, there is a third interfacial force between the aluminum oxide and the salt 230 ($\gamma_{salt/oxide}$). These three interfacial tensions have a relationship when an equilibrium condition is obtained which is indicated by equation (5).

$$\gamma_{Al/oxide}=\gamma_{oxide/salt}-\gamma_{Al/salt}\times\cos\theta \quad (5)$$

The contact angle (θ), a measure of wettability, is the angle between the tangent at the three-phase contact line and the solid oxide interface. Assuming that a thin oxide film of area (S) was stripped away from the aluminum droplet, leaving the droplet to have area (S) in contact with salt, the change in free energy of the system (ΔG) is given by equation (6).

$$\Delta G=S(\gamma_{oxide/salt}+\gamma_{Al/salt}-\gamma_{Al/oxide}) \quad (6)$$

The combination of equation (5) and equation (6) can be rewritten as equation (7).

$$\Delta G=S\gamma_{Al/salt}(1+\cos\theta) \quad (7)$$

In order to separate the oxide film from aluminum droplet, or in other words to dewet the aluminum droplet from oxide film, the free energy of the system should be reduced. This can be done by either lowering the aluminum/salt or oxide/salt interfacial tensions or raising the aluminum/oxide interfacial tension. If the interfacial tension between oxide and aluminum is increased, the change in free energy becomes negative and the oxide film removal is more spontaneous. However, as can be determined with equation (7), the removal of oxide film is not spontaneous since the interfacial tension between aluminum and salt is impossible to be negative. Therefore, the $\gamma_{Al/salt}$ value is reduced as low as possible and the contact angle θ is increased as large as possible.

In an embodiment the flux layer 120 comprises NaCl and KCl in an equimolar ratio. For example, in an embodiment the flux comprises approximately 30.8% by weight NaCl and approximately 39.2% by weight NaCl with the remainder comprising other constituents.

In an embodiment the flux comprises NaCl and KCl in an equimolar ratio as well as chlorides of Li, Ca, Mg, or their combinations. Non-limiting examples include NaCl and KCl in an equimolar ratio and LiCl and $CaCl_2$; NaCl and KCl in an equimolar ratio and $MgCl_2$ and $CaCl_2$; and NaCl and KCl in an equimolar ratio and LiCl, $CaCl_2$, and $MgCl_2$ and $CaCl_2$.

In an embodiment the flux comprises NaCl and KCl in an equimolar ratio as well as sulfates of Na, K, or their combinations. Non-limiting examples include NaCl and KCl in an equimolar ratio and $K_2SO_4$; NaCl and KCl in an equimolar ratio and $Na_2SO_4$; and NaCl and KCl in an equimolar ratio and $K_2SO_4$ and $Na_2SO_4$.

In an embodiment the flux comprises NaCl and KCl in an equimolar ratio as well as $CaCl_2$, LiCl, $MgCl_2$, $MgSO_4$, $Na_2SO_4$, $K_2SO_4$, or their combinations. Non-limiting examples include NaCl and KCl in an equimolar ratio and $Na_2SO_4$, LiCl and $CaCl_2$; NaCl and KCl in an equimolar ratio and $MgCl_2$ and $K_2SO_4$; and NaCl and KCl in an equimolar ratio and LiCl, $CaCl_2$, and $MgSO_4$, $K_2SO_4$, $Na_2SO_4$, $MgCl_2$ and $CaCl_2$.

In an embodiment the flux preferably comprises NaCl and KCl in an equimolar ratio as well as at least 0.5% by weight of $CaCl_2$, LiCl, $MgCl_2$, $MgSO_4$, $Na_2SO_4$, $K_2SO_4$, or their combinations. The flux more preferably comprises NaCl and KCl in an equimolar ratio as well as at least 10% by weight of $CaCl_2$, LiCl, $MgCl_2$, $MgSO_4$, $Na_2SO_4$, $K_2SO_4$, or their combinations. The flux even more preferably comprises comprises NaCl and KCl in an equimolar ratio as well as at least 20% by weight of $CaCl_2$, LiCl, $MgCl_2$, $MgSO_4$, $Na_2SO_4$, $K_2SO_4$, or their combinations.

In an embodiment the flux preferably comprises NaCl and KCl in an equimolar ratio as well as 4.0-6.0% by weight $CaCl_2$, 4.0-6.0% by weight LiCl, 4.0-6.0% by weight $MgCl_2$, 4.0-6.0% by weight $Na_2SO_4$, 6.5-8.5% by weight $K_2SO_4$ and 2.0-3.0% by weight $MgSO_4$. The flux more preferably comprises 29.8-31.8% by weight NaCl, 38.2-40.2% by weight KCl, 4.0-6.0% by weight $CaCl_2$, 4.0-6.0% by weight LiCl, 4.0-6.0% by weight $MgCl_2$, 4.0-6.0% by weight $Na_2SO_4$, 6.5-8.5% by weight $K_2SO_4$ and 2.0-3.0% by weight $MgSO_4$. The flux even more preferably comprises approximately 30.8% by weight NaCl, approximately 39.2% by weight KCl, approximately 5.0% by weight $CaCl_2$, approximately 5.0% by weight LiCl, approximately 5.0% by weight $MgCl_2$, approximately 5.0% by weight $Na_2SO_4$, approximately 7.5% by weight $K_2SO_4$ and approximately 2.5% by weight $MgSO_4$.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "approximately" is utilized herein to represent the inherent degree of uncertainty that may be attributed to any quantitative comparison, value, measurement, or other representation. In the present context, the term "approximately" is also utilized herein to represent the degree by which a quantitative representation may vary from a stated reference without resulting in a change in the basic function of the subject matter at issue. As such, it is utilized to represent the inherent degree of uncertainty that may be attributed to any quantitative comparison, value, measurement, or other representation, referring to an arrangement of elements or features that, while in theory would be expected to exhibit exact correspondence or behavior, may in practice embody something slightly less than exact.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of reducing entrained aluminum oxides in aluminum castings; the method comprising:

preheating a furnace charge of an aluminum alloy;

coating the furnace charge free surfaces with a layer of flux having approximately 30.8% by weight NaCl by dipping the furnace charge into a molten flux bath; and melting the furnace charge in a furnace to form a melt bath with a melt surface.

2. The method of claim 1, wherein coating the furnace charge free surfaces with a layer of flux further comprises coating the furnace charge free surface with a layer of flux at least approximately 1 mm in thickness.

3. The method of claim 1, wherein coating the furnace charge free surfaces with a layer of flux further comprises coating the furnace charge free surface with a layer of flux approximately 1 mm to approximately 2 mm in thickness.

4. The method of claim 1, wherein preheating a furnace charge of an aluminum alloy further comprises preheating the furnace charge to at least approximately 150° C.

5. The method of claim 4, wherein preheating a furnace charge of an aluminum alloy further comprises providing a melting furnace and using hot flue gases of the melting furnace for preheating the furnace charge of the aluminum alloy.

6. The method of claim 4, wherein preheating a furnace charge of an aluminum alloy further comprises providing a rotary kiln for preheating the furnace charge of the aluminum alloy.

7. The method of claim 6, wherein providing a rotary kiln for preheating the furnace charge an aluminum alloy further comprises providing a rotary kiln having an atmosphere including an oxygen level below the flammability limits of any organic contaminants on the aluminum alloy.

8. The method of claim 7, wherein providing a rotary kiln for preheating the furnace charge of an aluminum alloy further comprises providing a the rotary kiln having an oxygen level maintained below 6% oxygen by volume.

9. The method of claim 1, wherein preheating a furnace charge of aluminum alloy further comprises providing a side well furnace for preheating the furnace charge.

10. The method of claim 1, further comprising allowing the flux to float to the melt surface and form a cover flux.

11. The method of claim 1, wherein coating the furnace charge free surfaces with a layer of flux further comprises including a layer of flux having NaCl and KCl in an equimolar ratio.

12. The method of claim 11, wherein coating the furnace charge free surfaces with a layer of flux further comprises including a layer of flux having at least 0.5% by weight of at least one material selected from the group consisting of $CaCl_2$, LiCl, $MgCl_2$, $MgSO_4$, $Na_2SO_4$, $K_2SO_4$.

13. The method of claim 11, wherein coating the furnace charge free surfaces with a layer of flux further comprises including a layer of flux having 4.0-6.0% by weight $CaCl_2$, 4.0-6.0% by weight LiCl, 4.0-6.0% by weight $MgCl_2$, 4.0-6.0% by weight $Na_2SO_4$, 6.5-8.5% by weight $K_2SO_4$ and 2.0-3.0% by weight $MgSO_4$.

14. The method of claim 1, wherein coating the furnace charge free surfaces with a layer of flux further comprises including a layer of flux having chlorides of Li, Ca, or Mg; sulfates of Na or K; or their combinations.

15. A method of reducing entrained aluminum oxides in aluminum castings, the method comprising:

preheating a furnace charge of an aluminum alloy to at least approximately 150° C., coating the furnace charge free surfaces with a layer of flux at least approximately 1 mm in thickness by dipping the furnace charge into a molten flux bath and wherein the layer of flux comprises 29.8-31.8% by weight NaCl, 38.2%-40.2% by weight KCl, 4.0-6.0% by weight LiCl, 4.0-6.0% by weight $MgCl_2$, 4.0-6.0% by weight $Na_2SO_4$, 6.5-8.5% by weight $K_2SO_4$ and 2.0-3.0% by weight $MgSO_4$.

16. A method of reducing entrained aluminum oxides in aluminum castings; the method comprising:

preheating a furnace charge of an aluminum alloy to between approximately 150° C. and approximately 500° C. in a rotary kiln with an oxygen level maintained between 1% and 2% oxygen by volume, coating the furnace charge free surfaces with a layer of flux, and to between approximately 1 mm to approximately 2 mm in thickness, and wherein the flux comprises approximately 30.8% by weight NaCl, approximately 39.2% by weight KCl, approximately 5.0% by weight $CaCl_2$, approximately 5.0% by weight LiCl, approximately 5.0% by weight $MgCl_2$, approximately 5.0% by weight $Na_2SO_4$, approximately 7.5% by weight $K_2SO_4$ and approximately 2.5% by weight $MgSO_4$;

melting the furnace charge in a furnace to form a melt bath with a melt surface.

* * * * *